US011634301B2

(12) United States Patent
Swami et al.

(10) Patent No.: US 11,634,301 B2
(45) Date of Patent: Apr. 25, 2023

(54) SYSTEM AND METHOD FOR DETECTION OF A MALFUNCTION IN AN ELEVATOR

(71) Applicant: Otis Elevator Company, Farmington, CT (US)

(72) Inventors: Aditya Swami, Maharashtra (IN); Guru Charan Kottur, Telangana (IN); Daisuke Meguro, Tokyo (JP); Hiromitsu Miyajima, Chiba (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 1361 days.

(21) Appl. No.: 15/997,136

(22) Filed: Jun. 4, 2018

(65) Prior Publication Data

US 2018/0346284 A1 Dec. 6, 2018

(30) Foreign Application Priority Data

Jun. 5, 2017 (IN) ..... 201711019699

(51) Int. Cl.
*B66B 5/00* (2006.01)
*B66B 5/02* (2006.01)
*B66B 1/34* (2006.01)

(52) U.S. Cl.
CPC ..... *B66B 5/0012* (2013.01); *B66B 1/3461* (2013.01); *B66B 5/0031* (2013.01); *B66B 5/027* (2013.01)

(58) Field of Classification Search
CPC ..... B66B 5/00–0037; B66B 5/02–025
See application file for complete search history.

(56) References Cited

U.S. PATENT DOCUMENTS 5,241,141 A 8/1993 Cominelli
6,364,066 B1 * 4/2002 Bolch ..... B66B 5/027 187/391
8,418,815 B2 4/2013 Encinas Carreno et al.
8,459,415 B2 6/2013 Kwon et al.
8,540,057 B2 * 9/2013 Schuster ..... B66B 5/0006 187/247
8,554,556 B2 * 10/2013 Yu ..... G10L 25/78 704/233
8,893,858 B2 * 11/2014 Shi ..... B66B 5/0025 187/247

(Continued)

FOREIGN PATENT DOCUMENTS

CN 102750894 A 10/2012
CN 203212149 U 9/2013

(Continued)

OTHER PUBLICATIONS

European Search Report for application 18175781.6, dated Mar. 4, 2019, 11 pages.

(Continued)

*Primary Examiner* — Christopher Uhlir
(74) *Attorney, Agent, or Firm* — Cantor Colburn LLP

(57) ABSTRACT

A system and method for detection of a malfunction in an elevator. The system includes an elevator cab, a server, at least one sensor, and a controller. The controller receives a signal captured by the at least sensor and transmit to the server. The server processes the transmitted signal and prognostically detects the malfunction in the elevator cab.

8 Claims, 5 Drawing Sheets

(56) References Cited

U.S. PATENT DOCUMENTS

| | | | | |
|---|---|---|---|---|
| 9,045,314 | B2 * | 6/2015 | Finschi | B66B 1/468 |
| 9,580,276 | B2 | 2/2017 | Toutaoui | |
| 10,703,607 | B2 * | 7/2020 | Altenburger | B66B 5/02 |
| 2002/0009203 | A1 * | 1/2002 | Erten | H04R 1/406 381/94.1 |
| 2015/0114763 | A1 | 4/2015 | Kim et al. | |
| 2015/0284214 | A1 | 10/2015 | Park | |

FOREIGN PATENT DOCUMENTS

| | | | |
|---|---|---|---|
| CN | 203794388 | U | 8/2014 |
| CN | 204079142 | U | 1/2015 |
| CN | 204185055 | U | 3/2015 |
| CN | 104773625 | A | 7/2015 |
| CN | 105197712 | A | 12/2015 |
| CN | 105293238 | A | 2/2016 |
| CN | 105652315 | A | 6/2016 |
| CN | 105819295 | A | 8/2016 |
| EP | 3392181 | A1 | 10/2018 |
| KR | 20130088991 | A | 8/2013 |
| WO | 2008013515 | A2 | 1/2008 |
| WO | 2011073212 | A1 | 6/2011 |

OTHER PUBLICATIONS

Luo, Zhiqun et al., "Development on Seismic Sensor System with MEMS Technology for Elevator's Seismic Condition", Applied Mechanics and Materials, ISSN: 1662-7482, vols. 713-715, pp. 1009-1014.

* cited by examiner

SYSTEM AND METHOD FOR DETECTION OF A MALFUNCTION IN AN ELEVATOR

FOREIGN PRIORITY

This application claims priority to Indian Patent Application No. 201711019699, filed Jun. 5, 2017, and all the benefits accruing therefrom under 35 U.S.C. § 119, the contents of which in its entirety are herein incorporated by reference.

FIELD OF INVENTION

The present invention relates to elevator passenger assistance systems. In particular, the present invention relates to a system for prognostic detection of a trapped passenger in an elevator cab.

BACKGROUND OF THE INVENTION

Elevators have become an integral part of infrastructure and are the primary mode of commuting between floors in high rise towers. These elevators can sometimes inadvertently get stuck in the middle of their journey trapping passengers within them. Some of the primary causes leading to such situations include loss of building power, technical failure in one of the electrical or mechanical systems of the elevator, natural disasters such as earthquakes, misuse by the passengers, etc. Trapped passengers in elevators are at risk of panic attacks, suffocation, and distress. Some passengers with heart conditions might also be at risk of mortality.

Many prior-art solutions have focused on identifying faults in elevators by detecting jerks, shocks, and sudden movements in the elevators. For example, U.S. Pat. No. 8,893,858 discloses a remote elevator monitoring system having an accelerometer for measuring accelerations, vibrations, shocks, movements, and gravity accelerations etc. of the elevators to determine abnormal functioning of the elevator. The system also includes weight sensor and/or noise detection sensors to determine the current operational state of the elevator. Similarly, CN105819295, discloses an audio-based fault diagnostics system records audio signals within the elevator, eliminating the unwanted audio signal (like voice, music and sound effects), and measures the intensity of background noise to check for any faulty components making noise in the elevator. When the sound intensity exceeds the set threshold, a warning message is sent for diagnosis. However, not many prior arts have focused on identifying any trapped passengers in such faulty elevators. In some prior art solutions, to determine if there are passengers present in the elevators, weight sensors are used. However, weight sensors cannot distinguish between a living breathing human being and an inanimate object such as a trolley or luggage as the presence of both the human and the inanimate object can add weight to the elevator. Further, determination of background sound or noise intensity by some prior-arts can determine a faulty elevator but cannot determine presence of a trapped passenger within the elevator.

In addition, conventional methods of determining a trapped passenger are not very accurate. For example, a panic button in an elevator can be pushed inadvertently by passengers or by unknowing children, which leads to many false alarms. To prevent these false alarms there is a need for a prognostic method of determining trapped passengers whereby there is no need of a passenger to depend upon traditional methods of sending an alarm signal to determine that the passenger is trapped in the elevator.

OBJECTIVES OF THE INVENTION

A basic objective of the present invention is to overcome the disadvantages and drawbacks of the known art.

An objective of the present invention is to prognostically detect an elevator malfunction.

An objective of the present invention is prognostic detection of a trapped passenger in an elevator.

Another object of the present invention is to provide a centralized system for monitoring a large number of elevator cabs for prognostic detection of trapped passengers.

Yet another object of the present invention is to provide quick assistance to any passenger trapped in an elevator.

Yet another object of the present invention is to provide fast technician support to rescue the passengers trapped in the elevator.

Yet another object of the present invention is to provide information to the management/owners of a building that passengers are trapped in an elevator in their building.

Yet another object of the present invention is to connect a trapped passenger in an elevator with a customer care center.

These and other objects of the present invention are achieved in the preferred embodiments disclosed below by providing a system for detection of trapped passengers within an elevator cab.

SUMMARY OF THE INVENTION

The following presents a simplified summary of the invention in order to provide a basic understanding of some aspects of the invention. This summary is not an extensive overview of the present invention. It is not intended to identify the key/critical elements of the invention or to delineate the scope of the invention. Its sole purpose is to present some concept of the invention in a simplified form as a prelude to a more detailed description of the invention presented later.

Aspects of the present invention relate to a method for detection of a malfunction in an elevator cab comprising a controller, at least one sensor, and a server. The method includes inputting at least one signal captured by the at least one sensor, and processing the signal received from the sensor. The signal from the said at least one sensor is inputted and processed by the controller and transmitted to a server, and the said transmitted signal is processed at the server that prognostically detects the malfunction in the elevator cab. In some aspects, the server is in communication with the elevator cab via an internet connection. In some aspects, the server includes a processor, a machine learning system and a smart decision service. In some aspects, the at least one sensor includes a jerk detection sensor. In such aspects, the method includes identifying an elevator malfunction by the server by processing a jerk signal captured by the jerk detection sensor. In some aspects, the at least one sensor includes a microphone. In such aspects, the method includes identifying an elevator malfunction by the server by processing a sound captured by the microphone. In some aspects, the at least one sensor includes a breath detection sensor. In such aspects, the method includes identifying an elevator malfunction by the server by processing a breath detection signal captured by the breath detection sensor. In some aspects, the server prognostically detects the presence of a trapped passenger. In such aspects, if it is identified that a passenger is trapped in the elevator, the server connects the elevator cab to a customer care center, a human analyst, or an end user system. Further, in such aspects, if it is identified that a passenger is trapped in the elevator, the method includes a step of sending a notification to a technician device to inform a technician of the trapped passenger, wherein the technician device is one of a phone, a watch, or a portable device connected to the internet.

Aspects of the present invention also relate to a system for detection of a malfunction in an elevator comprising an elevator cab, a server, at least one sensor, and a controller configured to receive a signal captured by the at least sensor and transmit to the server. The server processes the transmitted signal and prognostically detects the malfunction in the elevator cab. In some aspects, the elevator cab is in communication with the server via an internet connection. In some aspects, the server prognostically detects the presence of a trapped passenger. In some aspects, the at least one sensor includes a jerk detection sensor. In such aspects, the jerk detection sensor includes at least one of a MEMS sensor, a pressure sensor, an accelerometer, or any such device. Further, in such aspects, the jerk detection sensor is placed in a wall, roof, or floor panel of the elevator cab, or is mounted on the controller, or in a sensor hub located in the elevator cab. In some aspects, the at least one sensor includes a microphone. In such aspects, the microphone is at least one of a condenser, dynamic, ribbon, carbon, piezoelectric, fiber optic, or Mems microphone. In some aspects, the at least one sensor includes a breath detection sensor. In such aspects, the breath detection sensor is at least one of a microphone or an ultrasonic sensor.

Aspects of the present invention further relates to a method for detection of a malfunction in an elevator cab comprising a controller, one or more microphones, a server. The method includes inputting, in the controller, at least one sound signal captured by the one or more microphones, processing, by the controller, the sound signal received from the one or more microphones, determining, by the controller, that the sound signal received by the one or more microphones has originated from the elevator cab, and transmitting the sound signal which has originated from the elevator cab to a server, and the said transmitted sound signal is processed at the server that prognostically detects the malfunction in the elevator cab. In some aspects, the server prognostically detects the presence of a trapped passenger. In some aspects, the one or more microphones include a first microphone positioned at a location inside the elevator cab and a second microphone positioned at a location outside the elevator cab, and wherein the method includes comparing, by the controller, the amplitude of a sound signal received by the first microphone with the amplitude of the sound signal received by the second microphone to determine if the sound signal has originated from the elevator cab. In some aspects, the one or more microphones include a first microphone positioned at a first location inside the elevator cab and a second microphone positioned at a second location inside the elevator cab, and wherein the method includes comparing, by the controller, the difference in the time of reception of a sound signal by the first and the second microphone to a range of time interval values to determine if the sound signal has originated from the elevator cab. In some aspects, the one or more microphones include a first microphone positioned at a first location inside the elevator cab, a second microphone positioned at a second location inside the elevator cab, and a third microphone positioned at a third location outside the elevator cab, and wherein the method includes comparing the difference in the time of reception of a sound signal by the first and the second microphone to a range of time interval values, and comparing the average amplitude of a sound signal received by the first and the second microphones with the amplitude of the sound received by the third microphone to determine if the sound has originated from the elevator cab.

Furthermore, aspects of the present invention relate to a system for detection of a malfunction in an elevator comprising an elevator cab; a server; one or more microphones positioned in the elevator cab; a controller configured to receive signals captured by the one or more microphones, determine that the signals received by the one or more microphones have originated from the elevator cab, and transmit the signals received by the one or more microphones which have originated from the elevator cab to a server. The server processes the transmitted signals and prognostically detects the malfunction in the elevator cab. In some aspects, the server prognostically detects the presence of a trapped passenger. In some aspects, the one or more microphones include a first microphone positioned at a location inside the elevator cab and a second microphone positioned at a location outside the elevator cab. In such aspects, the controller is configured to compare the amplitude of a sound signal received by the first microphone with the amplitude of the sound signal received by the second microphone to determine if the sound signal has originated from the elevator cab. In some aspects, the one or more microphones include a first microphone positioned at a first location inside the elevator cab and a second microphone positioned at a second location inside the elevator cab. In such aspects, the controller is configured to compare the difference in the time of reception of a sound signal by the first and the second microphone to a range of time interval values to determine if the sound signal has originated from the elevator cab. In some aspects, the one or more microphones include a first microphone positioned at a first location inside the elevator cab, a second microphone positioned at a second location inside the elevator cab, and a third microphone positioned at a third location outside the elevator cab. In such aspects, the controller is configured to compare the difference in the time of reception of a sound signal by the first and the second microphone to a range of time interval values, and compare the average amplitude of a sound received by the first and the second microphones with the amplitude of the sound received by the third microphone to determine if the sound has originated from the elevator cab.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF ACCOMPANYING DRAWINGS

Some of the objects of the invention have been set forth above. These and other objects, features, aspects and advantages of the present invention will become better understood with regard to the following description, appended claims and accompanying drawings where:

DETAILED DESCRIPTION OF INVENTION

The following detailed description should be read with reference to the drawings in which similar elements in different drawings are numbered the same. The drawings, which are not necessarily to scale, depict illustrative embodiments and are not intended to limit the scope of the invention. Although examples of construction, dimensions, and materials are illustrated for the various elements, those skilled in the art will recognize that many of the examples provided have suitable alternatives that may be utilized.

Definitions

Jerk—The term Jerk can be defined as the rate of change of acceleration; that is, the derivative of acceleration with respect to time, and as such the second derivative of velocity, or the third derivative of position.

System Overview

The present invention discloses a system of detection of trapped passengers in an elevator cab. The system is designed to monitor a large number of elevator cabs and provide prognostic assistance to any passenger(s) trapped in any one of the monitored elevator cabs. The system, in its basic configuration, includes an elevator cab connected to a central server via an active internet connection. The elevator cab further includes a jerk detection sensor, a microphone, and/or a breath detection sensor, and a controller. The jerk detection sensor can detect a jerk in the elevator cab:—any abrupt/sudden change/stoppage in the motion of a moving elevator or any abrupt/sudden disturbance in a stationary elevator. The microphone and/or the breath detection sensor can detect a passenger trapped in the elevator. The controller converts the signals detected by the jerk detection sensor and/or the microphone and/or the breath detection sensor into digital format and sends it over to the central server via an internet connection. The central server is designed to provide big data solutions with the received and stored information. The central server includes at least one processor that processes the signal received from the controller of the elevator cab to first identify a jerk. If a jerk is detected, then a machine learning system is applied to identify if the detected jerk has been caused by any malfunction in the elevator that could lead to trapping of passengers in the elevator. The machine learning system additionally uses, either separately or in combination with the jerk detection signal, the microphone and/or the breath detection sensor signal to prognostically detect a trapped passenger. If the machine learning system prognostically detects a trapped passenger, a smart decision service connects the elevator to at least one of a customer care center, a human analyst, a field technician, or building owner/management (end user) system of the building in which the elevator cab is located.

System Description

Figure 1:
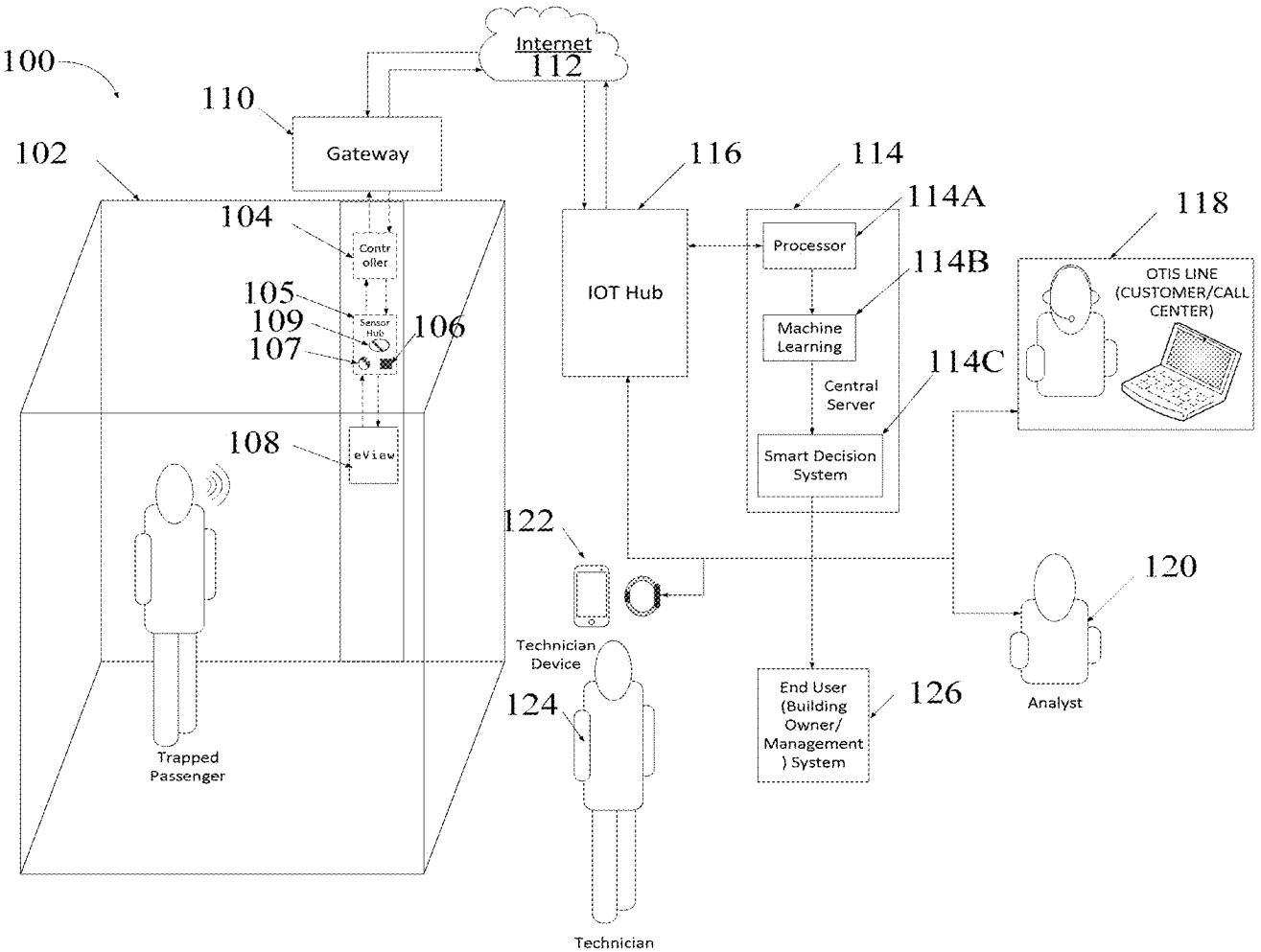
FIG. 1 illustrates a schematic diagram of the system of detection of trapped passengers in an elevator.

In an embodiment FIG. 1 illustrates a schematic diagram of a system 100 for detection of trapped passengers in an elevator. The system 100 includes an elevator cab 102 comprising a controller 104, a sensor hub 105 having at least one jerk detection sensor 106 and at least one microphone 107 and/or a breath detection sensor 109. The elevator cab 102, in some embodiments, can also include a passenger communication panel 108 connected to the controller 104. The controller 104 is connected to a gateway 110 which further connects the controller 104 to the internet 112. The system 100 further includes a central server 114, which is connected to an internet of things (IOT) hub 116, which further connects the central server 114 to the internet 112. The central server 114 includes a processor 114A and a machine learning system 114B for processing the signals received from a number of elevator cabs and prognostically detecting a trapped passenger. The central server 114 also includes a smart decision service 114C which connects/sends notification to a customer care center 118, an analyst 120, a technician 124 via a technician device 122, and/or an end user system 126 (building owner/management of the building in which the elevator cab is located) when a trapped passenger is prognostically detected.

System Elements:

Elevator Cab 102

The elevator cab 102 can be any type of elevator cab known in the art. In some embodiments, the elevator cab 102 is modified to host the components discussed here in a wall, roof, or floor panel. Preferably, in some embodiments, the components are mounted in a single wall panel of the elevator cab 102 close to average adult human height for ease of installation, operation, and maintenance.

Controller 104

The controller 104 is a customized microcontroller board that manages the control of various functionalities of the elevator cab 102. The controller 104 can be a microcontroller, a microcomputer, or a system on chip (SOC) device placed within a wall panel of the elevator cab 102. In some embodiments, the controller 104 is an off-the-shelf SOC available in the market.

In some embodiments, the controller 104 runs on a standard operating system (OS) such as a version of Linux™, Android™, Windows™, Mac OS™, or any other known operating system in the market. In some other embodiments, the controller 104 may run on a proprietary operating system. The controller 104 is operationally connected to the jerk detection sensor 106, the microphone 107 or a breath detection sensor 109, and the gateway 110. The controller 104 can have local data storage like a memory chip or a hard drive, and can locally store the signals received from the jerk detection sensor 106 and/or the microphone 107, and/or transmit the signals data via the gateway 110.

Sensor Hub 105

The sensor hub 105 is a collection of a number of sensors that can be used to measure/identify the state of the elevator cab 102, for example, the jerk detection sensor 106, the microphone 107, breath detection sensor 109, weight sensors, pressure sensors, temperature sensors, etc. In some embodiments, the sensor hub 105 is a printed circuit board (PCB) with various sensors mounted on it. In such embodiments, the sensor hub 105 is placed at any location within the elevator cab 102 for optimal functioning of the sensors, for example, in any wall panel, floor or roof panel of the elevator cab. The sensor hub 105 is operationally connected to the controller 104. In some other embodiments, the sensor hub 105 is a portion of a printed circuit board (PCB) also housing the controller 104. In some other embodiments, the sensor hub 105 comprises of a number of sensors that are distributed across the elevator cab 102, i.e. in wall panels, floor panels, roof panels, etc., depending upon their best placement for detection of their corresponding signals.

Jerk Detection Sensor 106

The jerk detection sensor 106 can be any sensor that can detect sudden changes in motion or stationary state of the elevator cab 102. In some embodiments, the jerk detection sensor 106 can be any one of a MEMS sensor, a pressure sensor, an accelerometer, or a microphone. In some preferred embodiments, the jerk detection sensor 106 is a MEMS sensor.

The jerk detection sensor 106 can be placed at any location within the elevator cab 102. The jerk detection sensor 106 can be placed in any wall panel, floor or roof panel of the elevator cab. In an alternative embodiment, the jerk detection sensor 106 can be integrated within the controller 104. In a preferred embodiment, the jerk detection sensor 106 is placed in the sensor hub 105 along with other sensors such as temperature sensors, weight detection sensors, etc. In some embodiments, more than one jerk detection sensors 106 can be placed in the elevator cab 102 at locations optimized for detection of jerks in the elevator cab 102.

Microphone 107

The microphone 107 can be any known type of microphone, such as a condenser, dynamic, ribbon, carbon, piezoelectric, fiber optic, or MEMS microphone. In some embodiments, the microphone 107 can also be used as the jerk detection sensor 106.

The microphone 107 can be placed at any location within the elevator cab 102. The microphone 107 can be placed in any wall panel, floor or roof panel of the elevator cab. In an alternative embodiment, the microphone 107 can be integrated within the controller 104. In a preferred embodiment, the microphone 107 is placed in the sensor hub 105 along with other sensors such as temperature sensors, weight detection sensors, etc. In some embodiments, more than one microphone 107 can be placed in the elevator cab 102 at locations optimized for detection of human sounds in the elevator cab 102.

Breath Detection Sensor 109

The breath detection sensor 109 determines the presence of a human or animal breath. The breath detection sensor 109 can be implemented by a number of devices known in the art, for example, sensitive pressure sensors can be used to determine small pressure changes within the elevator cab 102 to determine presence of breathing human or animal trapped inside the elevator cab 102. In some embodiments, the breath detection sensor 109 can be a regular or microphone that can be used to determine breathing sounds of a human being or animal within the elevator cab 102. Other known breath detection sensors that can be used may include ultrasonic sensors [Sensors (Basel). 2014 August 2014 (8): 15371-86. doi: 10.3390/s140815371.], Doppler multi-radar systems [Sensors 2015, 15(3), 6383-6398; doi:10.3390/s150306383], etc.

Passenger Communication Panel 108

The system 100 can optionally include a passenger communication panel 108. The passenger communication panel 108 can include elements such as a display, a microphone, a camera, and a speaker. The communication panel 108 can allow a passenger (trapped or not) in the elevator cab to connect with the customer care center 118 and communicate with a customer care representative at the center 118. In some embodiments, the microphone 107 can be a part of the passenger communication panel 108.

Gateway 110

The gateway 110 is an internet gateway known in the art and connects the controller 104 to the internet 112. The gateway 110 can be centrally located in a building and connects all the elevator cabs 102 within the building to internet 112.

Internet 112

The internet 112 is well known in the art and thus is not discussed in detail here.

Central Server 114

The controller 104 digitizes and transmits data captured by jerk detection sensor 106, the microphone 107 or the breath detection sensor 109 to the central server 114. The central server 114 is a computer server designed to provide big data solutions with stored information. The central server 114 includes a processor 114A, a machine learning system 114B, and a smart decision service 114C. The central server 114 receives data transmitted by the controller 104 of the elevator cabs 102 located in a building. The processor 114A processes the received information and the machine learning system 114B prognostically determines an elevator malfunction. The machine learning system 114B prognostically determines the presence of a trapped passenger within the elevator cab 102, and the smart decision service 114C, upon prognostic determination of a trapped passenger, connects the elevator to and/or sends a notification to a customer care center 118, an analyst 120, a technician 124, and/or an end user system 126.

Internet of Things (IOT) Hub 116

The central server 114 is connected to a number of controllers 104 of a number of elevator cabs 102 by the IOT Hub 116. The IOT Hub 116 is a computer network hub.

Customer Care Center 118

The customer care center 118 is a call center located at a remote location to other elements of the system 100. The customer care center 118 may include a number of customer care representatives trained to ameliorate anxiety of trapped passengers and to assist passengers in panic attacks or medical conditions.

Analyst 120

The Analyst 120 is a person trained in analyzing the information transmitted by the central server 114 to identify if any passengers are trapped in the elevator cab 102. The Analyst 120 can be located at the customer care center 118 or can be located at any other location remote to other components of the system 100.

Technician Device 122

Technician Devices 122 are smart portable devices such as smart watches or smart phones held by Technicians 124. The Technician Devices 122 can provide notifications to the Technician 124 about any trapped passengers in any elevator cab 102.

End-User System 126

The end user system 126 is a computer system/a number of computer systems that control(s) and monitor(s) the operations of all elevators in the building in which the elevator cab 102 is located. The building owner/management system 126 can be located within the building or at a location of the owner/operator of the building.

In operation, the system 100 can determine any trapped passengers in an elevator cab 102 and provide for a quick remediation and rescue operation. In an instance, the system 100 can determine any trapped passengers in the elevator cab 102. In some embodiments, the system 100 is adapted to determine any trapped passenger in an elevator cab 102 of particular manufacturer. In some embodiments, the system 100 is scalable to determination of a trapped passenger in a plurality of elevator cabs 102.

In a basic operation, the procedure carried out in the elevator cab 102 includes:

In a first step, the controller 104 collects input signals from the jerk detection sensor 106 and/or sound signals from the microphone 107 and/or breath detection signal from the breath detection sensor 109. The input can be collected via any wired or wireless connection to the at least one jerk detection sensor 106 and/or the at least one microphone 107 and/or the breath detection sensor 109 in the sensor hub 105. In some embodiments, the input collected is in analog format, while in some other embodiments the input is in digital format.

In a second step, the controller 104 converts the input received from jerk detection sensor 106 and/or the microphone 107 and/or the breath detection sensor 109 to digital format. In embodiments, where the signal received by the jerk detection sensor 106 and/or the microphone 107 and/or the breath detection sensor 109 are already digital, no encoding from analog to digital may be needed.

In a third step, the controller 104 transmits the digitized data to the central server 114 via the gateway 110 and the internet 112. In some embodiments, the controller 104 may filter and compress the signal before and/or after digitization to reduce the amount of data to be transmitted via the internet.

Once the data is transmitted by the elevator cab 102, it is received at the IOT Hub 116. The IOT Hub 116 then transmits the data to the central server 114. In some embodiments, there may be a number of central servers 114, each servicing a number of elevator cabs 102 depending upon bandwidth and capacity of the central server 114. For example, a single central server 114 may monitor 1000 elevator cabs and the IOT Hub 116 may connect to 10 different central servers 114, all monitoring a total of 10,000 elevator cabs 102. In such embodiments, the IOT hub 116 may direct data from a certain elevator cab 102 to a central server 114 depending on various factors such as bandwidth and capacity of each central server 114, building and/or location at which the elevator cab 102 is located, owner/manufacturer of the elevator cab 102, etc.

In an embodiment, in the central server 114 the following steps may be performed:

In a first step, the central server 114 receives the data transmitted by the elevator cab 102 from the IOT hub 116.

In a second step, the central server 114 then processes in the processor 114A, the received data to identify presence of any jerk that might have occurred in the elevator cab 102.

In a third step, if a jerk has occurred in the elevator cab 102, the processor 114A then passes the data to the machine learning system 114B.

In a fourth step, the machine learning system 114B compares the received jerk detection data with the normal graph of the elevator cab 102 recorded over a period of time.

In a fifth step, any abnormalities identified through the comparison of the fourth step are further compared with templates associated with faults in the elevator cab 102 to determine the cause of the abnormality.

In a sixth step, if a fault, such as a power-outage, technical problem, etc., is detected, the machine learning system 114B analyzes the microphone data to detect human voice/sounds in the elevator cab 102. Additionally or alternatively, the machine learning system 114B analyzes the breath detection sensor 109 signal data to detect human or animal breath in the elevator cab 102 (prognostically determines a trapped passenger).

In a seventh step, if a human voice/sound or human/animal breath is determined by the machine learning system 114B, then the machine learning system 114B sends the information and related data to the smart decision service 114C.

In an eighth step, the smart decision service 114C automatically decides whether to send the information and/or a notification to the human analyst 120, customer care center 118, field technician 124, and/or the end user system 126. In some other embodiments, the smart decision service 114C can automatically select the customer care center 118 and/or the field technician 124 on the basis of factors such as proximity to the elevator cab 102, common language spoken in the region and/or any other specific factors. In some embodiments, the smart decision service 114C upon determination of a trapped passenger can send notification to the technician device 122 for informing the field technician 124 of the trapped passenger. The smart decision service 114C can also inform the end user system 126 to either sound an alarm in the building or to inform the building management to take quick remedial actions. The smart decision service 114C can further connect the elevator cab 102 with the customer care center 118 via the communication panel 108 and the internet connection 112.

In some other embodiments, the smart decision service 114C can refer the information received from the machine learning system 114B to the human analyst 120 for further review. In these embodiments, for example, the smart decision service 114C can send information to the human analyst 120 to manually review the data and determine that any passenger is trapped in the elevator cab 102 or not. The analyst 120 can manually analyze the sound signals of the microphone 107 or the signals of the breath detection sensor 109 and via the smart decision service 114C send notification to the technician device 122 for informing the field technician 124 of the trapped passenger. The analyst 120 can also inform the end user system 126 to either sound an alarm in the building or to inform the building management to take quick remedial actions. The analyst 120 can further connect the elevator cab 102 with the customer care center 118 via the communication panel 108 and the internet connection 112.

In some embodiments, the microphone 107 may detect a human voice or sound from outside the elevator cab 102. For example, sounds of passengers waiting at an elevator passage/landing on a floor of a building to get into an elevator cab 102. Such sounds may lead to a false detection of trapped passengers in the elevator cab 102. To prevent such false detection, the following embodiments of the elevator cab 102 provide for determining whether the sounds are detected from within or outside the elevator cab 102.

Figure 2:
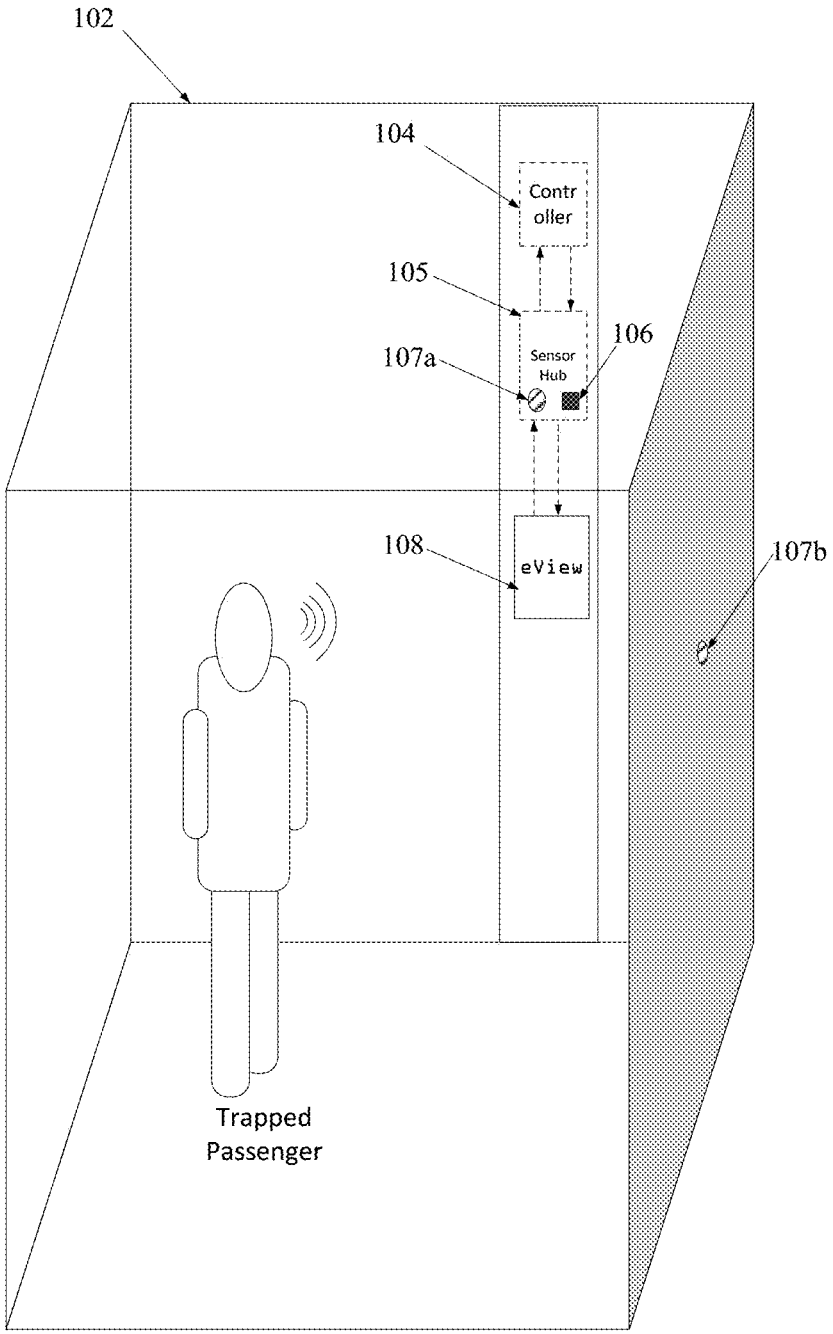
FIG. 2 illustrates a second embodiment of the elevator cab of the system shown with FIG. 1.

FIG. 2 illustrates an alternative embodiment of the elevator cab 102 of the system 100 shown in FIG. 1. In this embodiment, the elevator cab 102 includes a first microphone 107*a* positioned at a first location inside the elevator cab 102 and a second microphone 107*b* positioned at a second location outside the elevator cab 102. This arrangement of microphones 107*a* and 107*b* allows the controller 104 to determine a more accurate location of the source of sound than that can be detected by a single microphone. For example, the sound of a passenger trapped inside the elevator will be heard at a higher amplitude level in the microphone 107*a* placed inside the elevator cab 102 than the microphone 107*b* placed outside the elevator cab 102. The body of the elevator cab 102 absorbs sound and thus results in this attenuation of sound amplitude for the second microphone 107*b*. This difference in received/recorded sound amplitude is utilized for determining if the sound has originated from within or from outside the elevator cab 102.

Figure 3:
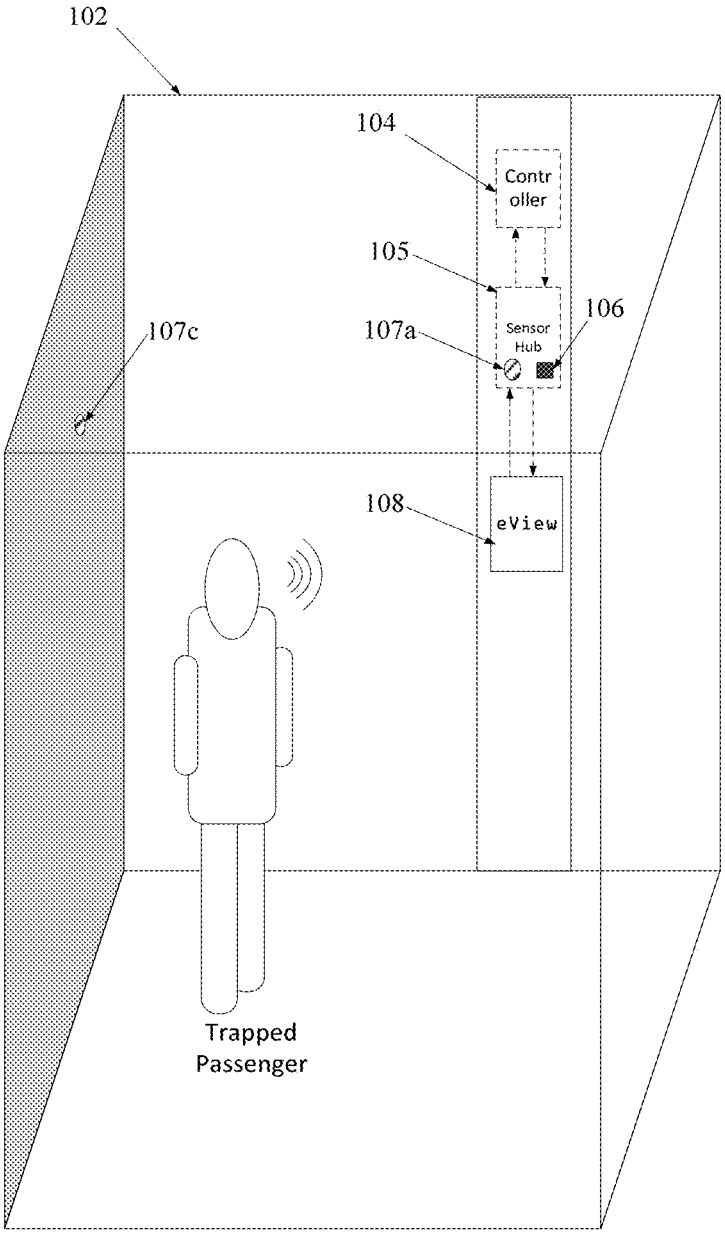
FIG. 3 illustrates a third embodiment of the elevator cab of the system shown with FIG. 1.

FIG. 3 illustrates yet another embodiment of the elevator cab 102 of the system shown with FIG. 1. In this embodiment, the elevator cab 102 includes a first microphone 107*a* positioned at a first location inside the elevator cab 102 and a second microphone 107*c* positioned at a second location inside the elevator cab 102. This arrangement of microphones 107*a* and 107*c* allows the controller 104 to determine a more accurate location of the source of sound than that can be detected by a single microphone. The amount of time difference between receptions of a sound by the microphones 107*a* and 107*c* can be used to determine if the source of sound is within or outside the elevator cab 102. Since the dimensions of the elevator cab 102 and the speed of sound are constant and can be pre-stored in the controller 104, it is possible to calculate a range of sound reception time interval differences of the microphones 107*a* and 107*c* that would indicate that the sound has originated from a source within the elevator cab 102. For example, if the time difference for reception of a sound by the microphones 107*a* and 107*c*, in an elevator cab 102 of particular dimensions, is within the range of 3 to 5 milliseconds, the sound has originated from within the elevator cab 102. This range can be determined by calculating the maximum and minimum distance of a source of sound from the microphones 107*a* and 107*c* that are possible within the dimensions of the elevator cab 102.

Figure 4:
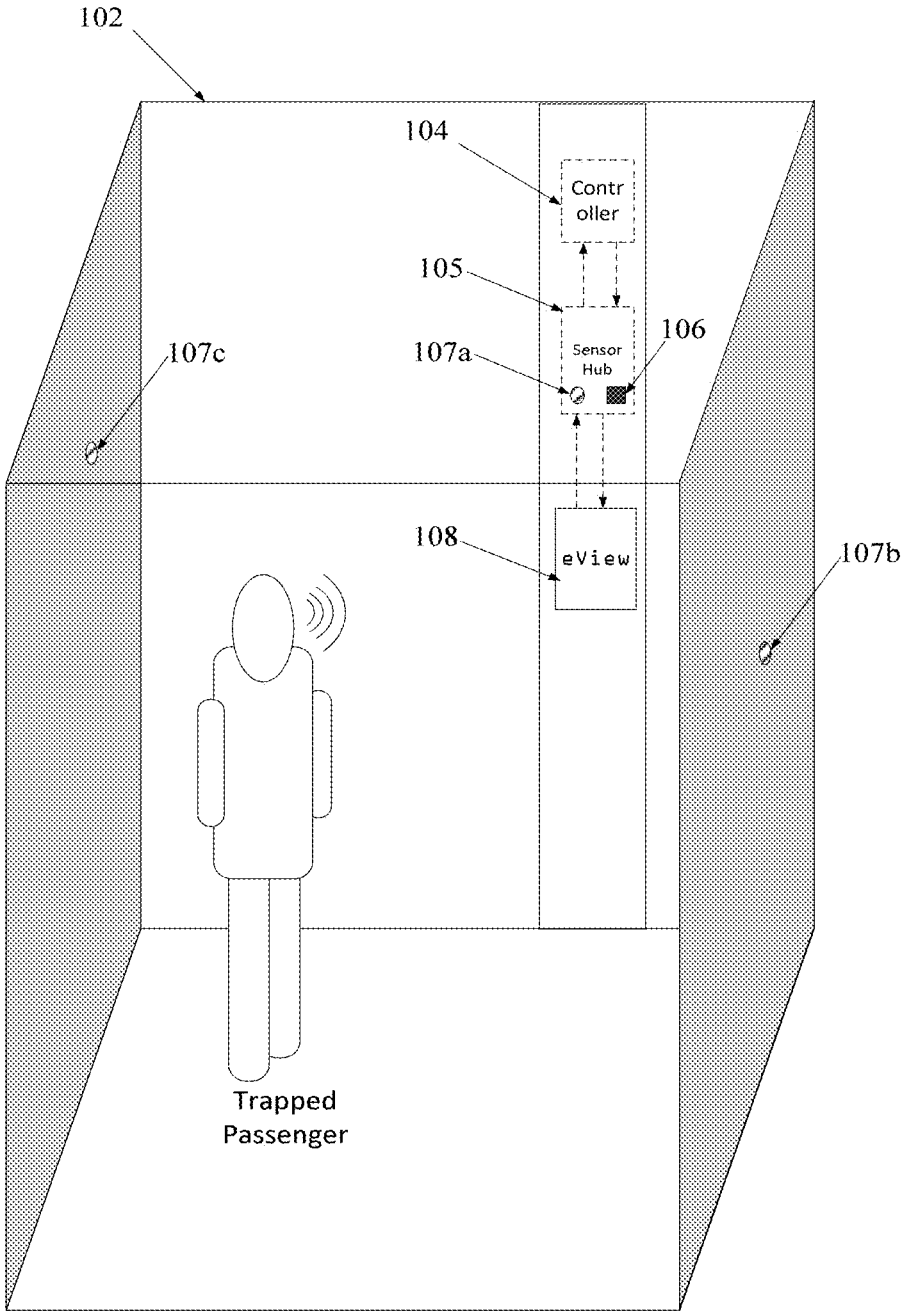
FIG. 4 illustrates a fourth embodiment of the elevator cab of the system shown with FIG. 1.

FIG. 4 illustrates another embodiment of the elevator cab 102 of the system shown with FIG. 1. In this embodiment, the elevator cab 102 includes a first microphone 107*a* positioned at a first location inside the elevator cab 102 and a second microphone 107*c* positioned at a second location inside the elevator cab 102, and a third microphone 107*b* positioned at a third location outside the elevator cab 102. Using the principles discussed above with embodiments of FIGS. 5 and 6, the amount of time difference between receptions of a sound by the microphones 107*a*-107*c* can be used by the controller 104 to determine if the source of sound is within or outside the elevator cab 102. Further, the amount of amplitude difference between the average sound amplitude received by microphones 107*a*-107*c* (inside the elevator cab) and the microphone 107*b* (outside the elevator cab) can be used by the controller 104 to further determine if the source of sound is within or outside the elevator cab 102.

In the embodiments, discussed with FIGS. 2, 3, and 4 respectively, to improve efficiency of the system 100 and to reduce any error or false detection, only the human or animal sounds that are identified/detected to be from originated within the elevator cab 102 are transmitted by the controller 104 to the central server 114 for further analysis and operations.

In some instances, a passenger trapped inside the elevator cab can be unconscious, disabled, or injured such that the passenger is not able to speak or call for help. In such instances, an embodiment of the elevator cab 102 may be employed with a breath detection sensor to detect if a breathing living human or animal is present in the elevator cab 102.

Figure 5:
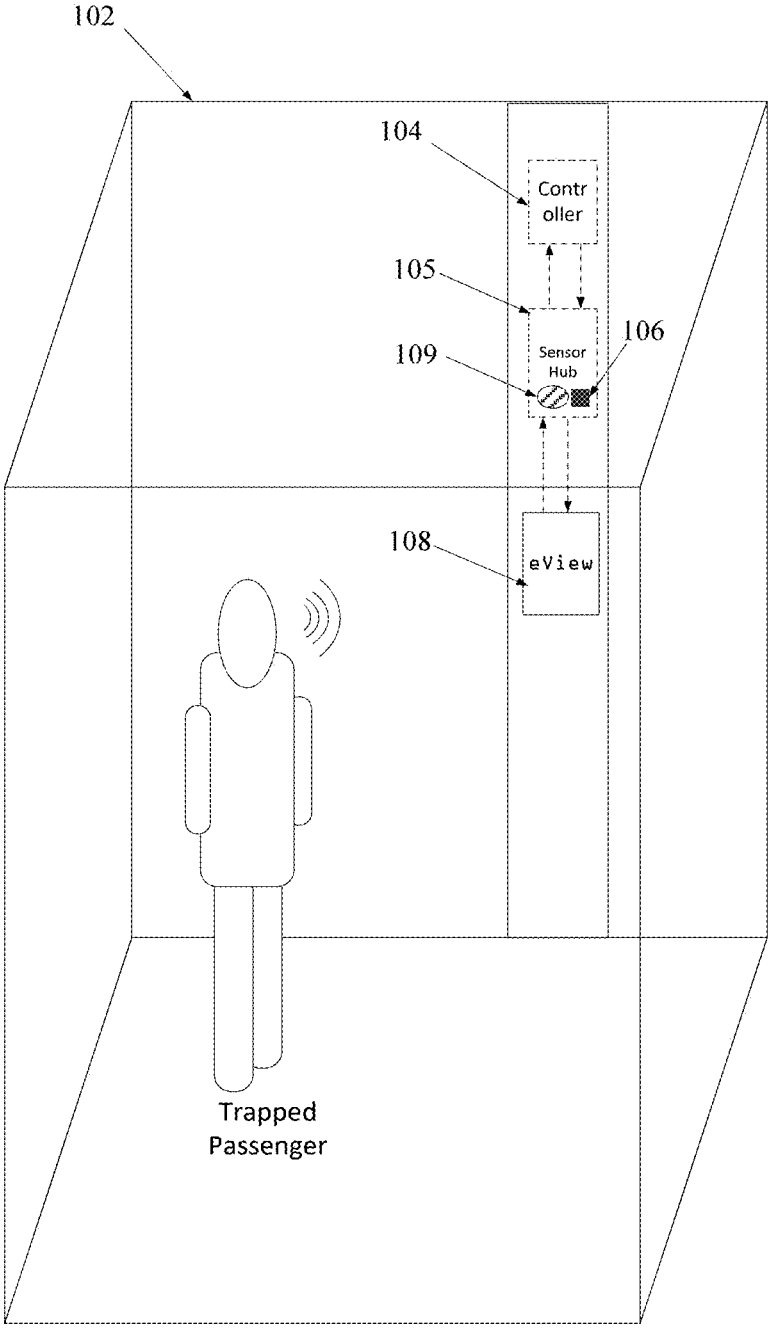
FIG. 5 illustrates a fifth embodiment of the elevator cab of the system shown with FIG. 1.

FIG. 5, for example, illustrates yet another embodiment of the elevator cab 102 of the system shown with FIG. 1. The elevator cab 102 employs only a breath detection sensor 109, to determine presence of a breathing human being within the elevator cab 102. The signals from the breath detection sensor 109 in this embodiment can be transmitted by the controller 104 to the central server 114 for determination of a trapped passenger within a faulty elevator cab 102.

In some embodiments, for example, in some variations of the embodiments discussed in FIGS. 1, 2, 3, 4, and 5, the jerk detection sensor 106 may not be included or required. Another sensor, for instance, the microphone(s) in case of embodiments described in FIGS. 1-4, or the breath detection sensor 109 in case of embodiments described in FIGS. 1 and 5 may be used to determine occurrence of jerks resulting in elevator malfunction in the elevator cab 102.

For example, referring to embodiment of FIG. 1, in some embodiments, the microphone 107 can be used to determine both jerks as well as human or animal sounds or human or animal breath. In such embodiments, the signal captured by the microphone can be filtered and segregated into a range of frequencies produced by the motion of the elevator and a range of frequencies of sounds associated with humans and animals. These segregated signals can be processed at the server 114, i.e. the former signal can be processed for identification of jerks and the later signal can be processed for determination of trapped passengers as described in the embodiments above.

Similarly, the signals captured by the microphones 107*a*, 107*b*, and 107*c*, described with embodiments of FIGS. 2, 3, and 4 can be segregated to determine both jerks as well as trapped passengers.

Further, the breath detection sensor 109, in some instances may capture artifacts that are proportional to the motion or occurrence of jerks in the elevator, such signal can be segregated from the sensor signal to act as the jerk detection signal, thereby eliminating the need for a separate jerk detection sensor.

Various other modifications, adaptations, and alternative designs are of course possible in light of the above teachings. Therefore, it should be understood at this time that within the scope of the appended claims the invention might be practiced otherwise than as specifically described herein.

ADVANTAGES

A basic advantage of the present invention is that it prognostically detects a trapped passenger in an elevator.

Another advantage of the present invention is that it prognostically detects an elevator malfunction.

Another advantage of the present invention is that it provides fast technician support to rescue the passengers trapped in the elevator Yet another advantage of the present invention is that it provides quick assistance to any passenger trapped in an elevator.

Yet another advantage of the present invention is that it informs the owners/management of a building that a passenger is trapped in one of its elevators.

What is claimed is:

1. A method for detection of a malfunction in an elevator cab comprising a controller, one or more microphones, a server, the method comprising:

inputting, in the controller, at least one sound signal captured by the one or more microphones;

processing, by the controller, the at least one sound signal received from the one or more microphones;

determining, by the controller, that the at least one sound signal received by the one or more microphones has originated from the elevator cab; and transmitting the at least one sound signal which has originated from the elevator cab to a server; and wherein the at least one sound signal is processed at the server that detects the malfunction in the elevator cab;

wherein the one or more microphones include a first microphone positioned at a first location inside the elevator cab and a second microphone positioned at a second location inside the elevator cab, and wherein the method includes comparing, by the controller, a difference in a time of reception of a sound signal by the first microphone and the second microphone to a range of time interval values to determine if the at least one sound signal has originated from the elevator cab.

2. The method according to claim 1, wherein the server is in communication with the elevator cab via an internet connection.

3. The method according to claim 1, wherein the server includes a processor, a machine learning system and a smart decision service.

4. The method according to claim 1, wherein if it is identified that a passenger is trapped in the elevator, the server connects the elevator cab to a customer care center, a human analyst, or an end user system.

5. The method according to claim 1, wherein if it is identified that a passenger is trapped in the elevator, the method includes a step of sending a notification to a technician device to inform a technician of the trapped passenger, wherein the technician device is one of a phone, a watch, or a portable device connected to the internet.

6. A method for detection of a malfunction in an elevator cab comprising a controller, one or more microphones, a server, the method comprising:

inputting, in the controller, at least one sound signal captured by the one or more microphones;

processing, by the controller, the at least one sound signal received from the one or more microphones;

determining, by the controller, that the at least one sound signal received by the one or more microphones has originated from the elevator cab; and transmitting the at least one sound signal which has originated from the elevator cab to a server; and wherein the at least one sound signal is processed at the server that detects the malfunction in the elevator cab;

wherein the one or more microphones include a first microphone positioned at a first location inside the elevator cab, a second microphone positioned at a second location inside the elevator cab, and a third microphone positioned at a third location outside the elevator cab, and wherein the method includes:

comparing a difference in a time of reception of a sound signal by the first microphone and the second microphone to a range of time interval values, and comparing an average amplitude of a sound signal received by the first microphone and the second microphone with an amplitude of a sound received by the third microphone to determine if the at least one sound has originated from the elevator cab.

7. A system for detection of a malfunction in an elevator comprising:

an elevator cab;

a server;

one or more microphones positioned in the elevator cab;

a controller configured to:

receive signals captured by the one or more microphones;

determine that the signals received by the one or more microphones have originated from the elevator cab; and transmit the signals received by the one or more microphones which have originated from the elevator cab to a server, wherein the server processes the transmitted signals and detects the malfunction in the elevator cab;

wherein the one or more microphones include a first microphone positioned at a first location inside the elevator cab and a second microphone positioned at a second location inside the elevator cab;

wherein the controller is configured to compare a difference in a time of reception of a sound signal by the first microphone and the second microphone to a range of time interval values to determine if the sound signal has originated from the elevator cab.

8. A system for detection of a malfunction in an elevator comprising:

an elevator cab;

a server;

one or more microphones positioned in the elevator cab;

a controller configured to:

receive signals captured by the one or more microphones;

determine that the signals received by the one or more microphones have originated from the elevator cab; and transmit the signals received by the one or more microphones which have originated from the elevator cab to a server, wherein the server processes the transmitted signals and detects the malfunction in the elevator cab;

wherein the one or more microphones include a first microphone positioned at a first location inside the elevator cab, a second microphone positioned at a second location inside the elevator cab, and a third microphone positioned at a third location outside the elevator cab;

wherein the controller is configured to:

compare a difference in a time of reception of a sound signal by the first microphone and the second microphone to a range of time interval values, and compare an average amplitude of a sound received by the first and the second microphones with an amplitude of a sound received by the third microphone to determine if the sound has originated from the elevator cab.

* * * * *